US006296349B1

(12) United States Patent
Samples

(10) Patent No.: US 6,296,349 B1
(45) Date of Patent: Oct. 2, 2001

(54) ALIGNING A TAB CIRCUIT ON PRINT HEAD INTERSECTING SURFACES

(75) Inventor: Robert Samples, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/466,717

(22) Filed: Dec. 17, 1999

(51) Int. Cl.[7] ..... B41J 2/05; B41J 2/01
(52) U.S. Cl. ..... 347/58; 347/59; 29/33.5
(58) Field of Search ..... 347/7, 43, 87, 347/59, 58, 50, 209; 437/209; 29/833, 33.5, 603.01, 603.19, 603.04, 603.07, 825.02, 825, 729

(56) References Cited

U.S. PATENT DOCUMENTS

| | | | | |
|---|---|---|---|---|
| 4,980,971 | | 1/1991 | Bartschat et al. | 29/833 |
| 5,300,457 | | 4/1994 | Schlitz et al. | 437/209 |
| 5,434,607 | * | 7/1995 | Keefe | 347/50 |
| 5,538,586 | | 7/1996 | Swanson et al. | 156/307.6 |
| 5,610,635 | | 3/1997 | Murray et al. | 347/7 |
| 5,635,966 | | 6/1997 | Keefe et al. | 347/43 |
| 5,637,166 | | 6/1997 | Swanson et al. | 156/73.1 |
| 5,652,608 | | 7/1997 | Watanabe et al. | 347/50 |
| 5,706,040 | | 1/1998 | Reid et al. | 347/50 |
| 5,748,209 | | 5/1998 | Chapman et al. | 347/50 |
| 5,751,323 | | 5/1998 | Swanson et al. | 347/87 |
| 5,992,013 | * | 11/1999 | Morita | 29/833 |

* cited by examiner

*Primary Examiner*—N. Le
*Assistant Examiner*—Matthew T. Welker
(74) *Attorney, Agent, or Firm*—John A. Brady

(57) ABSTRACT

Methods and apparatus are provided for aligning a TAB circuit on first and second intersecting surfaces of a print head. The methods comprise aligning a chip portion of the TAB circuit on the first surface and applying a progressive force along the contact pad portion of the TAB circuit to align the contact pad portion on the second surface of the print head. The apparatus comprise a machine for aligning the chip portion of the TAB circuit on the first surface and roller for applying a progressive force along the contact pad portion of the TAB circuit to align the contact pad portion on the second surface.

23 Claims, 6 Drawing Sheets

ALIGNING A TAB CIRCUIT ON PRINT HEAD INTERSECTING SURFACES

TECHNICAL FIELD

The present invention relates to methods and apparatus for aligning a TAB circuit to first and second intersecting surfaces of a print head, for example an inkjet print head, wherein a contact pad portion of the TAB circuit is aligned to the second surface of the print head by applying a progressive force along the contact pad portion of the TAB circuit after a chip portion of the TAB circuit is aligned on the first surface.

BACKGROUND OF THE INVENTION

Thermal inkjet (TIJ) technology is widely used in computer printers. TIJ cartridges typically comprise a print head mounted to a tape automated bonded circuit, commonly known as a "TAB circuit." TAB circuits are well known in the art as illustrated by U.S. Pat. Nos. 4,989,317 and 4,944,850. A print head typically has a plurality of precisely-formed nozzles, each nozzle being in fluid communication with a chamber that receives ink from an ink reservoir. Each chamber is adjacent to an electrical resistance element, known as a TIJ resistor, which is located opposite the nozzle so that ink can collect between the nozzle and the resistor. Electric printing pulses heat the TIJ resistor, causing a small portion of the ink adjacent to the resistor to vaporize, thereby propelling the ink through the nozzle of the print head toward a print medium. The ejected drops collect on the medium and form printed characters and/or images thereon. The printing is generally accomplished by incrementally moving the medium in a first direction relative to the print head and moving the print head in a second direction which is perpendicular to the first direction. As a plurality of nozzles may be supplied across the print head, a number of droplets may be fired from the print head simultaneously. The spacing of the nozzles and the incremental stepping of the print head and the medium define the resolution of the printed image. Further examples of this process can be found in U.S. Pat. No. 5,637,166.

Fabrication of a TIJ cartridge typically entails primarily three steps: the making of the print head itself; the making of a TAB circuit; and the alignment and attachment of the TAB circuit to the print head. The TAB circuit attaches to the print head so as to provide electrical contact and communication between the TIJ printer and the TIJ cartridge. As shown in FIG. 1, a TAB circuit 20 typically comprises a chip portion 30 and a contact pad portion 40. Electrical connection between contact pads 45 and the chip portion 30 is made by conductive traces 50. The electrical signals from the TIJ printer pass through the contact pad portion of the TAB circuit and travel to the chip portion of the TAB circuit. The chip portion of the TAB circuit is sometimes referred to as the heater chip. This chip will translate the signals passed to it from the contact pad portion of the TAB circuit to selectively heat small portions of adjacent ink. The ink is then propelled and collected onto a medium as described above.

Methods and apparatus for alignment and attachment of the TAB circuit to the print head are well known in the art and typically use a machine vision apparatus, for example as disclosed in U.S. Pat. No. 4,980,971, which is incorporated herein by reference.

Typically, the chip portion and the contact pad portion of the TAB circuit are attached on first and second intersecting surfaces, respectively, of the print head. In a conventional system, the chip portion of the TAB circuit is aligned by using a machine vision apparatus that optically locates two sets of datum points, one set on the first surface of the print head and one set on the TAB circuit, while a gripping arm holds the print head in place. Alignment of the chip circuit must be highly precise to ensure print quality and to accommodate ever increasing consumer demands for better print resolution.

Once alignment is achieved, the machine vision apparatus will then attach the chip portion of the TAB circuit to the first surface of the print head. Various methods for attachment are known in the art, as disclosed by U.S. Pat. No. 5,637,166 and can employ glues, seals, gaskets, heat staking, etc. Following alignment and attachment of the chip portion, a force is applied to the top surface of the chip portion of the TAB circuit and the first surface of the print head so as to maintain the chip alignment and attachment in the succeeding fabrication steps. Alignment may also be maintained with pressure sensitive adhesive or a heat activated bonding film. Additionally, alignment may be maintained by fast curing UV dots of adhesive placed under and around the chip portion of the TAB circuit.

Next, a gripper arm holding the contact pad portion of the TAB circuit rotates or folds the TAB circuit in order to align and attach the contact pad portion of the TAB circuit to the second surface of the print head using attachment methods as discussed above The attachment location on the second surface of the print head is determined by a computer-learned process. As a result, the TAB circuit is folded at or adjacent the intersection of the first and second surfaces of the print head.

The movement of the gripping arms and/or folding of the TAB circuit often apply forces to the already attached chip portion of the TAB circuit which result in misalignment of the attached chip portion. Additionally, the folding step can create a gap between the TAB circuit and the print head which is believed to be necessary in order to provide slack or movement in the contact pad portion of the TAB circuit during contact pad alignment and attachment. Yet, this gap is not a desirable feature. FIG. 2 illustrates a TAB circuit 20*a*, including a chip portion 30*a* and a contact pad portion 40*a*, which is aligned and attached to a print head 10*a* using a conventional technique. As shown in FIG. 2, a gap 160*a* often occurs where the TAB circuit is aligned at or adjacent the point of intersection 100*a* of surfaces 60*a* and 70*a*. Also, because the machine vision apparatus frequently needs operator intervention to reprogram and relearn contact pad alignment positions, frequent production delays and increased expense result. The equipment associated with the precision alignment of the contact pad portion to the second surface of the print head is also expensive. Finally, increasing demands in the market for the miniaturization of print cartridges have made it difficult to ensure accuracy of chip and contact pad alignment to a print head with the existing fabrication techniques in the art. Prior methods cannot provide the higher precision required with miniaturization because to do so requires smaller and more accurate drops of the gripping arms during contact pad alignment and attachment. These drops are already fraught with problems and to require them to be even more precise is not practical.

Accordingly, a need exists for methods and apparatus for improving this TAB circuit alignment on a print head.

SUMMARY OF THE INVENTION

Accordingly, it is an object of the present invention to overcome the disadvantages of prior methods and/or apparatus for TAB circuit alignment and attachment. It is related object of the present invention to provide improved methods and/or apparatus for aligning the contact pad portion of a TAB circuit on a print head. It is a related object to provide such methods and apparatus wherein accurate alignment can be achieved, preferably using less complex equipment and requiring less manual intervention as compared with conventional methods and apparatus.

To achieve the forgoing and other objects, methods for aligning a TAB circuit on a print head are provided. The methods comprise providing a print head having a first surface and a second surface which intersects the first surface, aligning a chip portion of a TAB circuit on the first surface of the print head, and applying a progressive force along a contact pad portion of the TAB circuit to align the contact pad portion on the second surface.

In a preferred embodiment, a progressive force is applied along a contact pad portion of the TAB circuit to align the contact pad portion on the second surface, while maintaining the print head in a stationary position. This embodiment ensures that no movement in the print head occurs while aligning the contact pad portion of the TAB circuit to the second surface of the print head.

In a further embodiment, the invention is directed to apparatus for aligning a TAB circuit on first and second intersecting surfaces of a print head. The apparatus comprise means for aligning a chip portion of the TAB circuit on the first surface of the print head and means for applying a progressive force along a contact pad portion of the TAB circuit to align the contact pad portion on the second surface. The progressive force is preferably a compliant roller progressively applied against the contact pad portion of the TAB circuit and the second surface of the print head.

In a preferred embodiment, the apparatus for aligning a TAB circuit on first and second intersecting surfaces of a print head according to the invention comprise a machine vision apparatus capable of aligning a chip portion of the TAB circuit to the first surface of the print head and a pressure applicator operative to progressively apply a force along a contact pad portion of the TAB circuit to align the contact pad portion on the second surface.

As will be appreciated by those skilled in the art, the methods and apparatus discussed above will reduce forces placed on the chip portion of a TAB circuit during folding and alignment; isolate any force placed on the chip portion of the TAB circuit in a uniform one-directional manner away from the chip portion of the TAB circuit; permit more accurate alignment of the chip portion of the TAB circuit; eliminate the gap between the TAB circuit and the print head which often results in conventional methods; and/or reduce the expense associated with maintaining and operating the fabrication equipment used in the TAB alignment and attachment process.

Still other objects and advantages of the present invention will become apparent to those skilled in this art from the following description wherein there are shown and described preferred embodiments of this invention, simply for purposes of illustration. As will be realized, the invention may take on aspects and arrangements other than those described in detail below without departing from the scope of the invention, as defined by the claims.

BRIEF DESCRIPTION OF THE DRAWINGS

While the specification concludes with claims particularly pointing out and distinctly claiming the invention, it is believed that the invention will be better understood from the following description taken in conjunction with the accompanying drawings in which:

DETAILED DESCRIPTION

Figure 1:
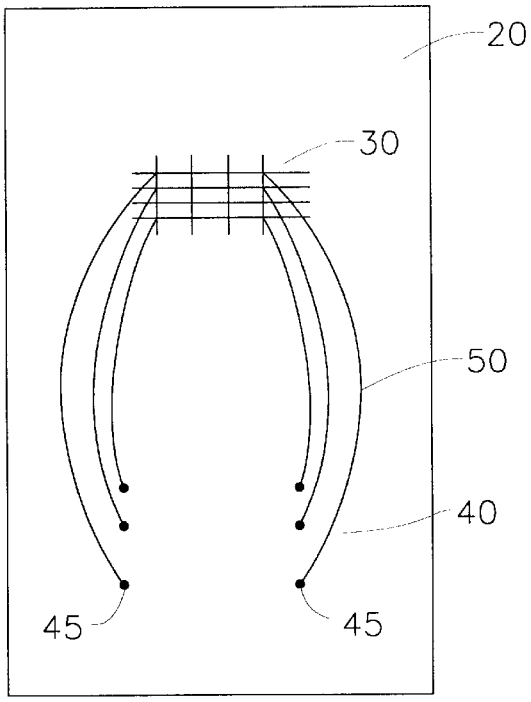
FIG. 1 PRIOR ART
FIG. 1 illustrates a conventional TAB circuit containing a chip portion and a contact pad portion.
Figure 3:
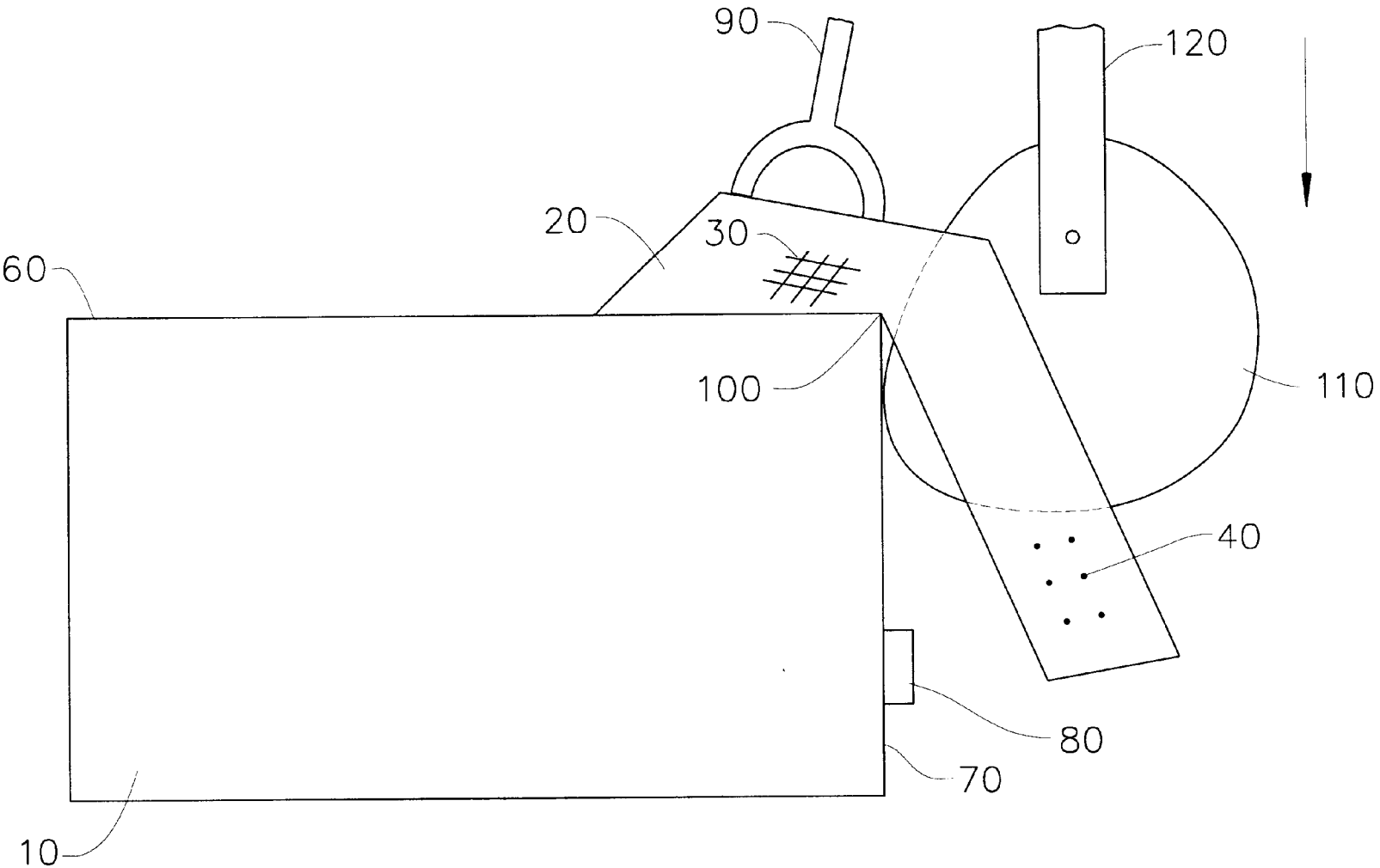
FIG. 3 illustrates a first embodiment of the methods and apparatus of the invention.

Referring now to the drawings in detail, FIG. 3 is a diagram depicting a method and an apparatus for aligning and attaching a TAB circuit 20 to a print head 10. As shown in FIG. 1, the TAB circuit 20 comprises a chip portion 30 and a contact pad portion 40 having a plurality of electrical contact pads 45 thereon. The electrical wiring 50 connects the electrical contact pads 45 to the chip portion 30 of the TAB circuit 20.

Referring again to FIG. 3 and the TAB circuit 20 of FIG. 3, the print head 10 includes first and second intersecting surfaces 60 and 70, respectively. The chip portion 30 of the TAB circuit 20 is aligned on the first surface 60 of the print head 10. The alignment of the chip portion 30 may be achieved using any fabrication method known in the art, including but not limited to, those discussed above in the background section. Preferably, the chip portion 30 of the TAB circuit 20 is then attached to the first surface 60 of the print head 10. The attachment of the chip portion 30 may be achieved using any means known in the art, including but not limited to adhesives, heat, pressure or otherwise, seals, gaskets, heat staking and the like.

Figure 5:
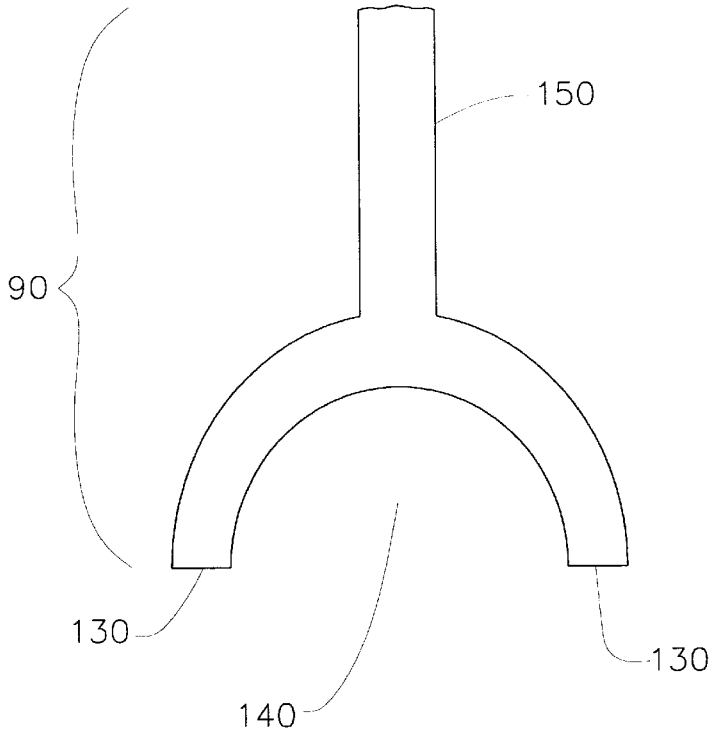
FIG. 5 illustrates an embodiment of a structure which may be used to maintain a chip portion of a TAB circuit on the first surface of the print head in another embodiment of the methods according to the invention.

Prior to aligning the contact pad portion 40 on the second surface 70 of the print head 10, it is preferred to apply a force to the chip portion 30 to maintain the alignment and/or attachment of the chip portion 30 on the first surface 60. For example, as shown in FIG. 3, a foot 90 may be placed onto the chip portion 30 of the TAB circuit 20 so as to hold the chip portion 30 of the TAB circuit 20 to the first surface 60 of the print head 10. FIG. 5, shows in greater detail the foot 90 which may be used. As shown in FIG. 5, the foot 90 includes a foot arm 150, two foot bases 130 and a foot recess 140. The foot bases 130 rest along the outer edges of the chip portion 30 of the TAB circuit 20 as depicted in FIG. 3 so as to not damage the conductive traces 50. The foot recess 140 surrounds but does not contact the chip portion 30 of the TAB circuit. One skilled in the art will appreciate that other devices may alternatively be applied or used to maintain the alignment and/or attachment of the chip portion 30 on the first surface 60.

Figure 6:
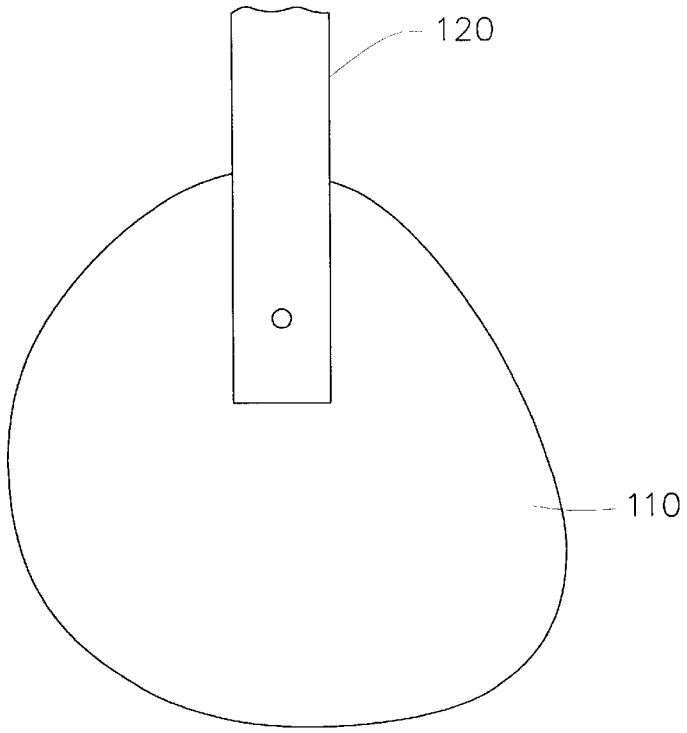
FIG. 6 illustrates one embodiment of the means for applying a progressive force along the contact pad portion of the TAB circuit.

Finally, a progressive force is applied along the contact pad portion 40. As shown in FIGS. 3 and 6, a preferred means for applying the progressive force comprises a compliant roller 110 attached to a roller arm 120. Any number of different apparatus may be employed so as to force a roller or other pressure applicator against the TAB circuit as one skilled in the art may readily appreciate.

The compliant roller 110 or other pressure applicator is pressed against and progressively moved, for example by rolling along the contact pad portion 40 of the TAB circuit 20 from a starting location 100 at or adjacent the intersection of the first surface 60 and the second surface 70 of the print head 10. Application of the progressive force bends the TAB circuit at a point at or adjacent the intersection 100 of the surfaces and aligns the contact pad portion 40 on the second surface 70. Preferably, the contact pad portion 40 of the TAB circuit 20 is attached to the print head 10 with a pressure sensitive adhesive 80. The adhesive 80 may be applied so as to cover a greater area on the second surface 70 of the print head 10, as compared with that illustrated in the FIG. 3. Furthermore, the compliant roller 110 could be heated in such a way as to heat stake the contact pad portion 40 directly on the second surface 70. The compliant roller 110 could alternatively activate a heat activated bonding film to achieve attachment of the contact pad portion 40 to the second surface 70.

Preferably, print head 10 remains stationary while the above described method proceeds. However, as one skilled in the art will appreciate, a roller or other pressure applicator could be stationary and a print head and TAB circuit could be moved relative to the pressure applicator so as to progressively press the TAB circuit into its aligned position on the printhead.

Figure 4:
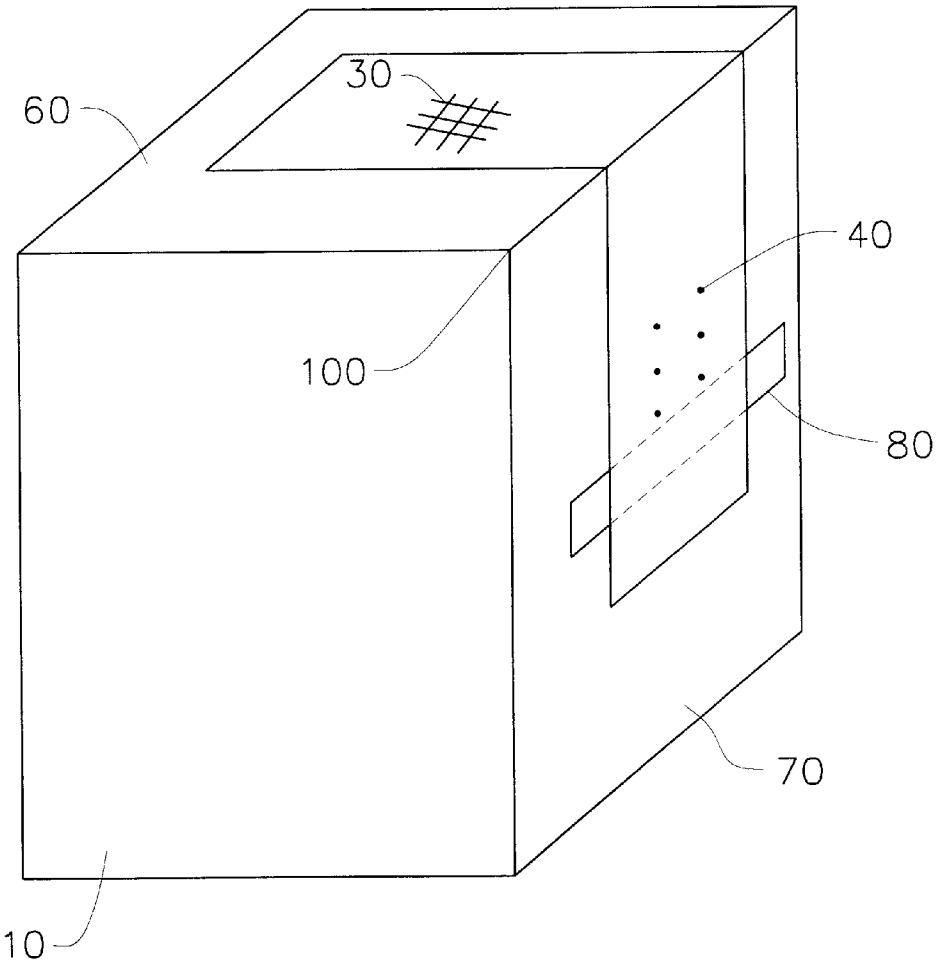
FIG. 4 illustrates a print head with a TAB circuit aligned thereon according to a method of the invention.

FIG. 4 illustrates a print head 10 which has a contact pad portion 40 of the TAB circuit 20 aligned to the second surface 70 of the print head by the method described above and depicted in FIG. 3. As will be appreciated by those skilled in the art, the above recited description will allow for a more efficient alignment of a contact pad portion 40 of a TAB circuit 20 while reducing forces (with the aid of the foot 90) which tend to misalign the position of the chip portion 30 of the TAB circuit 20, thereby providing for an improved alignment of a TAB circuit 20 on a print head 10. This alignment is more accurate, does not produce a gap 160*a* (FIG. 2), and as will be further discussed below provides for a more cost effective fabrication environment.

Figure 7:
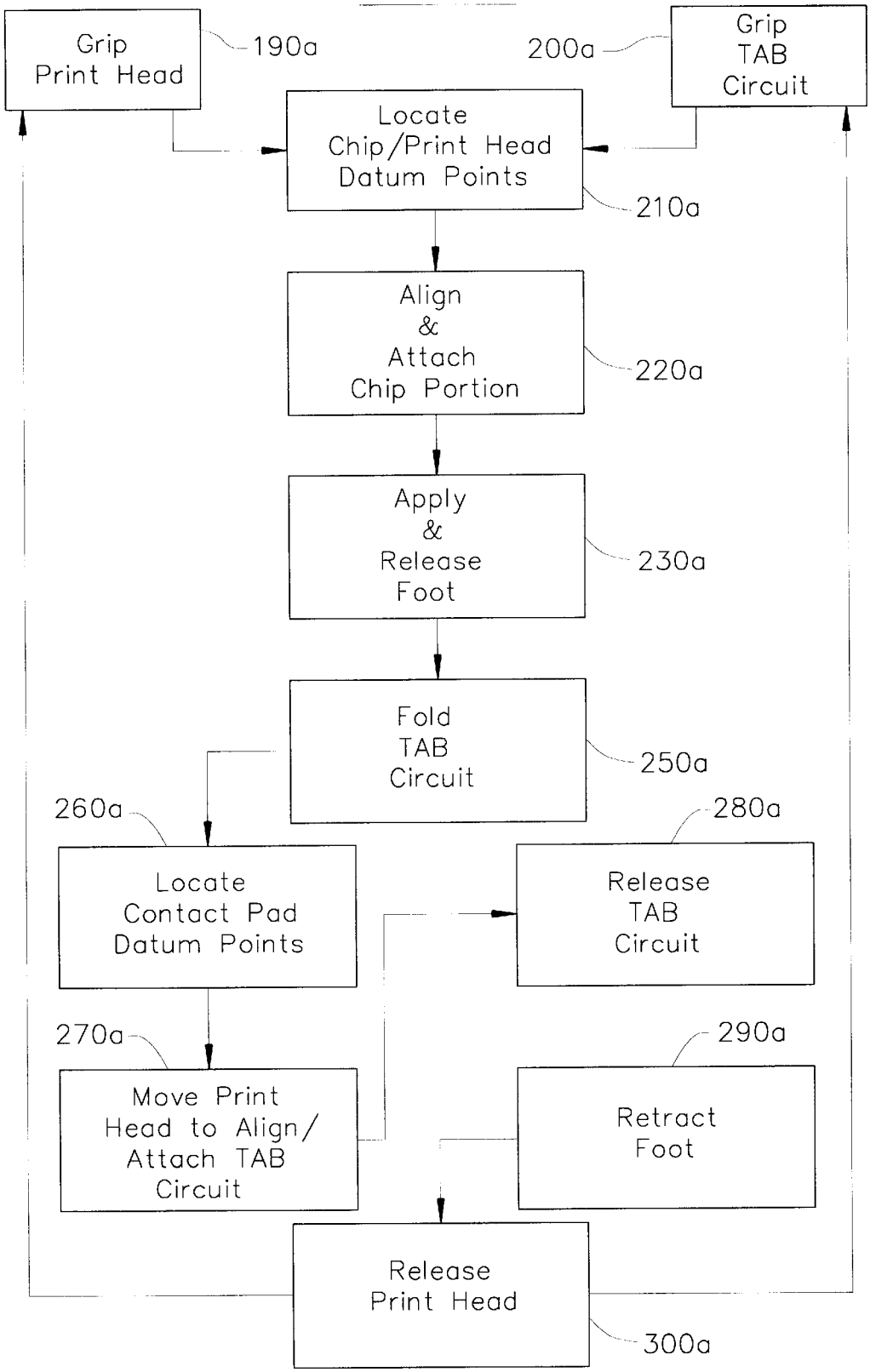
FIG. 7 PRIOR ART
FIG. 7 illustrates is a flow diagram depicting the steps in a prior art method used to align a TAB circuit.

FIG. 7 is flow diagram illustrating the fabrication steps in a conventional system to align and attach a chip portion and a contact pad portion of a TAB circuit to a first surface and a second surface of a print head using a machine vision apparatus. Initially in steps 190*a* and 200*a,* the print head and the TAB circuit are gripped. An optical device locates two sets of datum points in step 210*a,* one set on the chip portion and one set on the first surface of the print head. Next, the chip portion of the TAB circuit is aligned and attached in step 220*a* to the first surface of the print head. Pressure is applied to the chip portion of the TAB circuit and the first surface of the print head by means of a foot as described above in step 230*a*. The TAB circuit is then folded in step 250*a*. Contact pad datum points are located in step 260*a* and the print head is moved to align and attach the contact pad portion of the TAB circuit in step 270*a*. Finally, the TAB circuit is released in step 280*a;* the pressure foot is retracted in step 290*a;* and the grip on the print head is released in step 300*a*. The steps are then repeated for the next print head and the next TAB circuit to be assembled.

Figure 2:
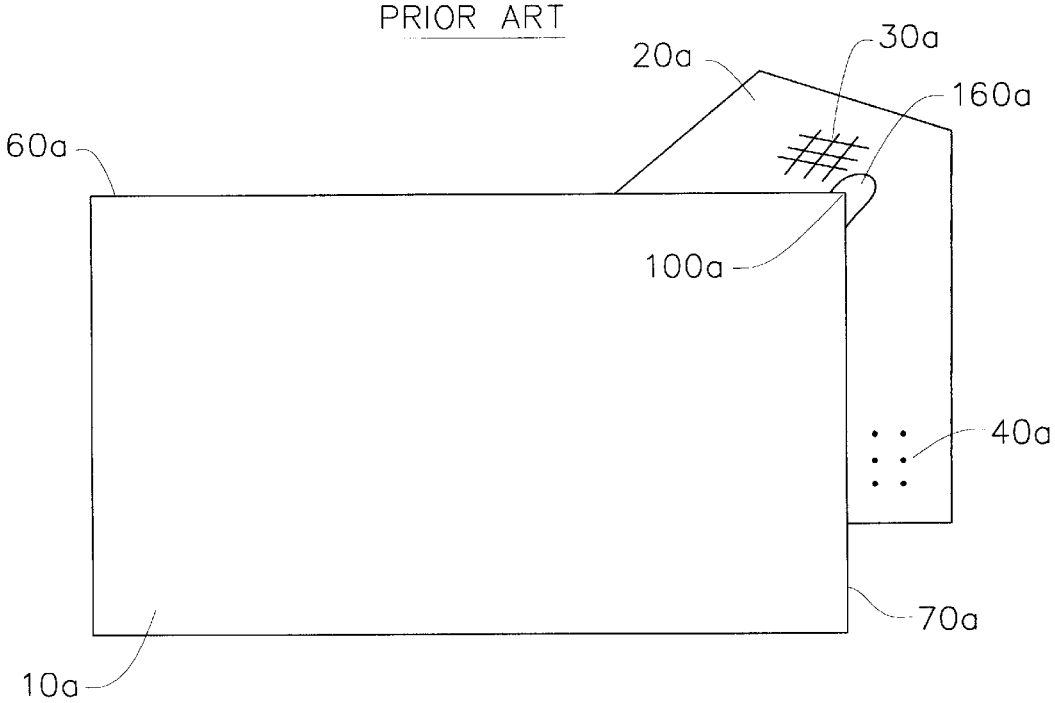
FIG. 2 PRIOR ART
FIG. 2 illustrates a print head with a TAB circuit thereon formed using conventional methods to align and attach the TAB circuit on the print head.

As shown in FIG. 2, this folding of the TAB circuit 20*a* and the aligning and attaching of the contact pad portion 40*a* of the TAB circuit 20*a* result in a gap 160*a* at the intersection 100*a* of the first surface 60*a* and second surface 70*a*. Conventional practice believes that the benefit that the gap 160*a* provides in reducing tension on the previously aligned chip portion 30*a* during alignment of the contact pad portion 40*a,* outweighs the risk of creating a defective print cartridge by the presence of the gap 160*a*. Therefore, conventional methods have not strived to eliminate the formation of such a gap.

The present invention not only further reduces the tension on the previously aligned chip portion 30 of a TAB circuit 20, but, as shown in FIG. 4 also eliminates any gap between the TAB circuit 20 and the print head 10, thereby decreasing overall print cartridge defects which might be introduced as a result of such a gap. Some of these undesirable gap defects include ink accumulating under the gap, and, if the gap becomes too large, interference between the TAB circuit (attached to the print head) and the printer components can result, thereby creating electrical communication problems.

Figure 8:
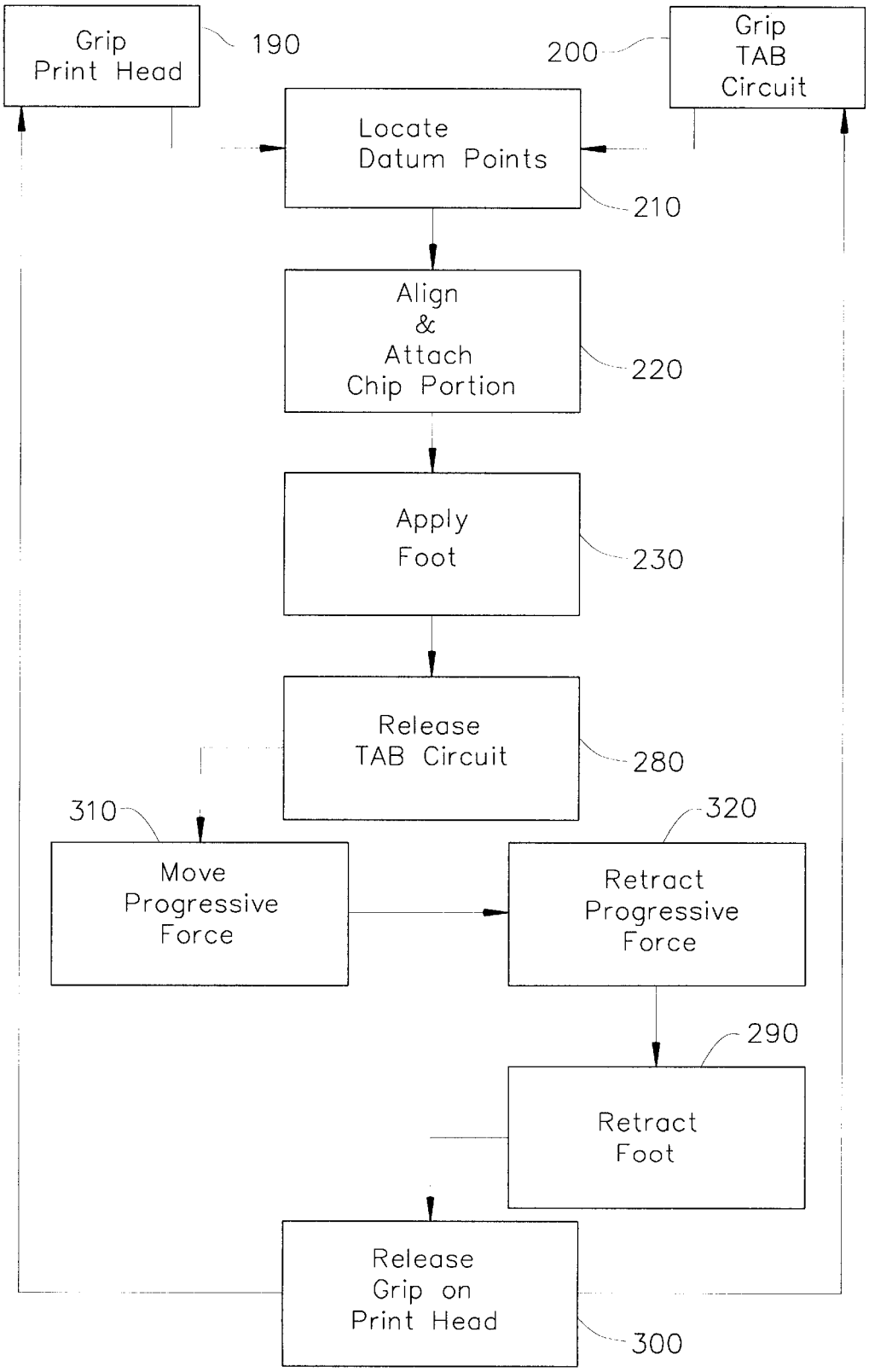
FIG. 8 illustrates a flow diagram depicting the steps in an embodiment of the present inventive methods to align a TAB circuit to a print head using a progressive force.

Finally, FIG. 8 is a flow diagram illustrating the steps associated with a preferred method according to the present invention and employing a machine vision apparatus. Initially the print head 10 and the TAB circuit 20 are acquired and gripped in steps 190 and 200, respectively. Next, in step 210, two sets of datum points are located, one on the chip portion 30 and one on the first surface 60 of the print head 10. In step 220, the chip portion 30 of the TAB circuit 20 is aligned and attached to the first surface 60 of the print head 10. Pressure is applied, for example by lowering a foot 90 onto the chip portion 30 of the TAB circuit 20 and the first surface 60 of the print head 10 in step 230. The TAB circuit 20 is released from the gripper in step 280 and a progressive force is applied in step 310. For example, a complaint roller 110 is engaged through a roller arm 120 and progressively moved along the contact pad portion 40 of the TAB circuit 20 at a starting point near the intersection 100 of first and second surfaces. Finally, in step 320, the compliant roller 110 is retracted by the roller arm 120. The foot 90 is retracted in step 290 and the print head 10 is released in step 300. The steps are repeated for the next print head 10 and TAB circuit 20 to be assembled.

One skilled in the art will readily appreciate that the above disclosed steps associated with a machine vision apparatus will eliminate costly precision equipment associated with conventional methods requiring alignment of the contact pad portion of the TAB circuit with the print head. Additionally, since the introduction of a progressive force is used, preferably embodied as a compliant roller 110, interruptions in production fabrication to reprogram the precise datum points on a second surface of a print head, are reduced. That is datum points are no longer needed to align a contact pad portion of a TAB circuit to a print head.

While preferred exemplary embodiments of the present invention have been described above, it is to be understood that further adaptations of the invention described herein can be obtained by appropriate modifications by one of ordinary skill in the art without departing from the scope of the present invention. Accordingly, although preferred configurations of methods and apparatus embodying the present invention have been described, it should be understood that these methods and apparatus may take on a wide variety of configurations and arrangements without departing from the scope of the present invention. For example, the methods of the present invention could be implemented with computer programs, and such programs may take on a number of forms, utilize a variety of variable names and commands, and be implemented in any of a number of programming languages without departing from the scope of the invention. Therefore, the scope of the present invention should be considered in terms of the following claims and should not be limited to the details of the structures and methods shown and described above.

What is claimed is:

1. A method for aligning a TAB circuit on a print head, comprising:

providing a print head having a first surface and a second surface which intersects the first surface;

aligning a chip portion of a TAB circuit on the first surface; and applying a progressive force along a contact pad portion of the TAB circuit to align the contact pad portion on the second surface.

2. The method as recited in claim 1, further comprising attaching the aligned chip portion to the first surface.

3. The method as recited in claim 1, further comprising attaching the aligned contact pad portion to the second surface with an adhesive.

4. The method as recited in claim 1, wherein the alignment of the chip portion on the first surface is maintained during the application of the progressive force along the contact pad portion.

5. The method as recited in claim 1, wherein the progressive force is applied with a roller.

6. The method as recited in claim 1, wherein the progressive force is initially applied at or adjacent an intersection of the first surface and the second surface and progresses along the contact pad portion such that the first surface and the second surface are in contact with the TAB circuit at or adjacent the intersection.

7. A method according to claim 1, wherein the contact pad portion comprises a plurality of electrical contact pads.

8. A print head assembly, produced according to the method of claim 1 and comprising, the TAB circuit aligned on the print head.

9. A method for aligning a TAB circuit on a print head, comprising:

providing a print head having a first surface and a second surface which intersects the first surface;

aligning a chip portion of a TAB circuit on the first surface; and applying a progressive force along a contact pad portion of the TAB circuit to align the contact pad portion on the second surface while maintaining the print head in a stationary position.

10. A method as recited in claim 9, further comprising attaching the aligned chip portion to the first surface.

11. The method as recited in claim 9, further comprising attaching the aligned contact pad portion to the second surface with an adhesive.

12. The method as recited in claim 9, wherein the alignment of the chip portion on the first surface is maintained during the application of the progressive force along the contact pad portion.

13. The method as recited in claim 9, wherein the progressive force is initially applied at or adjacent an intersection of the first surface and the second surface and progresses along the contact pad portion such that the first surface and the second surface are in contact with the TAB circuit at or adjacent the intersection.

14. An apparatus for aligning a TAB circuit on a first and a second intersecting surfaces of a print head, comprising:

means for aligning a chip portion of a TAB circuit on the first surface; and means for applying a progressive force along a contact pad portion of the TAB circuit to align the contact pad portion on the second surface.

15. The apparatus according to claim 14, further comprising means for attaching the aligned chip portion to the first surface.

16. The apparatus according to claim 14, further comprising means for attaching the aligned contact pad portion to the second surface with an adhesive.

17. The apparatus according to claim 14, further comprising means for maintaining the alignment of the chip portion on the first surface during the application of the progressive force along the contact pad portion.

18. The apparatus according to claim 14, wherein the means for applying a progressive force includes means for initially applying force on the contact pad portion at or adjacent the intersection of the first surface and the second surface and means for progressively applying force from the point of initial application along the contact pad portion such that the first surface and the second surface are in contact with the TAB circuit at or adjacent the intersection.

19. An apparatus for aligning a TAB circuit on a first and second intersecting surface of a print head, comprising:

a machine vision apparatus capable of aligning a chip portion of a TAB circuit to the first surface; and a pressure applicator operative to progressively apply a force along a contact pad portion of the TAB circuit to align the contact pad portion on the second surface.

20. An apparatus according to claim 19, further comprising means for attaching the aligned chip portion to the first surface.

21. An apparatus according to claim 19, further comprising means for attaching the aligned contact pad portion to the second surface with an adhesive.

22. An apparatus according to claim 19, wherein the machine vision apparatus is capable of maintaining the alignment of the chip portion on the first surface during the application of force along the contact pad portion.

23. An apparatus according to claim 19, wherein the pressure applicator is operative to initially apply a force at or adjacent an intersection of the first and the second surfaces and to apply a force progressively from the initial point of application along the contact pad portion such that the first surface and the second surface are in contact with the TAB circuit at or adjacent the intersection.

* * * * *